US007322387B2

(12) United States Patent
Landry et al.

(10) Patent No.: US 7,322,387 B2
(45) Date of Patent: Jan. 29, 2008

(54) RECEPTION, PROCESSING, HANDLING AND DISTRIBUTION OF HYDROCARBONS AND OTHER FLUIDS

(75) Inventors: David Charles Landry, Madisonville, LA (US); Roger Jacques Maduell, Amite, LA (US)

(73) Assignee: Freeport-McMoRan Energy LLC, New Orleans, LA (US)

( * ) Notice: Subject to any disclaimer, the term of this patent is extended or adjusted under 35 U.S.C. 154(b) by 436 days.

(21) Appl. No.: 10/932,197

(22) Filed: Sep. 2, 2004

(65) Prior Publication Data

US 2005/0061396 A1 Mar. 24, 2005

Related U.S. Application Data

(60) Provisional application No. 60/499,715, filed on Sep. 4, 2003.

(51) Int. Cl.
*B65B 1/04* (2006.01)

(52) U.S. Cl. ..... 141/382; 141/11; 141/82; 141/95; 141/387; 405/53; 62/53.1

(58) Field of Classification Search ..... 141/1, 141/2, 11, 18, 82, 95, 98, 382, 387; 62/45.1, 62/50.1, 53.1; 405/53
See application file for complete search history.

(56) References Cited

U.S. PATENT DOCUMENTS 3,256,705 A * 6/1966 Dimentberg ..... 62/50.1
4,024,720 A * 5/1977 Dimentberg et al. ..... 62/50.1
4,317,474 A 3/1982 Kentoch
5,129,759 A 7/1992 Bishop
5,511,905 A 4/1996 Bishop et al.
6,003,603 A 12/1999 Breivik et al.
6,298,671 B1 10/2001 Kennelley et al.
6,434,948 B1 8/2002 Eide et al.
6,516,616 B2 * 2/2003 Carver et al. ..... 60/659
6,517,286 B1 2/2003 Latchem
6,584,781 B2 7/2003 Bishop et al.
6,655,155 B2 12/2003 Bishop
6,725,671 B2 4/2004 Bishop
6,739,140 B2 5/2004 Bishop et al.
6,945,055 B2 * 9/2005 Bishop et al. ..... 62/53.1

* cited by examiner

*Primary Examiner*—Timothy L. Maust
(74) *Attorney, Agent, or Firm*—Jones, Walker, Waechter, Poitevent, Carrere & Denegre, LLP

(57) ABSTRACT

An integrated energy hub facility capable of bringing together all aspects of hydrocarbon and other fluid product movement under controlled conditions applicable to the reception, storage, processing, collection and transmission downstream is provided. Input to the energy hub includes natural gas and crude from a pipeline or a carrier, LNG from a carrier, CNG from a carrier, and carrier-regassed LNG, as well as other products from a pipeline or a carrier. Storage can be above surface, in salt caverns or in subterranean formations and cavities, and include petroleum crude, natural gas, LPG, NGL, GTL and other fluids. Transmission downstream may be carried out by a vessel or other type of carrier and/or by means of a pipeline system. Cryogenic fluids are offloaded and sent to the energy hub surface holding tank, then pumped to the energy hub vaporizers and sent to underground storage and/or distribution.

52 Claims, 4 Drawing Sheets

* Marine vessel, ship, boat, barge, tank truck, land transport and others.

RECEPTION, PROCESSING, HANDLING AND DISTRIBUTION OF HYDROCARBONS AND OTHER FLUIDS

This application is a non-provisional application for patent entitled to a filing date and claiming the benefit of earlier-filed Provisional Application for Patent No. 60/499,715, filed on Sep. 4, 2003 under 37 CFR 1.53 (c).

FIELD OF THE INVENTION

This invention relates to the reception, processing, handling and distribution of hydrocarbons and other fluids. Particularly, this invention relates to a method and system for transporting, offloading, handling, regasifying, storing and distributing hydrocarbons and other fluids. More particularly, the invention relates to a method and system for the offloading, regasification, storage and distribution of liquefied natural gas and other hydrocarbons at a central location using limited volume of surface holding tank capacity and conventional vaporization technology. Specifically, the invention relates to a novel technique for combining existing proven components found in liquefied natural gas terminals and offshore loading systems in order to provide improved efficiencies in the offloading, regasification, storage and distribution of liquefied natural gas and other fluids.

BACKGROUND OF THE INVENTION

The use of liquefied natural gas ("LNG") and other petroleum fluids as the source of fuel for industrial use and home heating continues to increase due to their availability and convenience. These petroleum fluids often take the form of cryogenic fluids, which are made by pressurizing and cooling hydrocarbon gases until they turn into liquids at very low temperatures. As such, the cryogenic fluids have to be transported from their original sources, which are often located in remote areas, to processing facilities where they are processed by various techniques in order to convert them into the type of commercial gas product that may be stored and/or sent to be distributed in the gas marketplace. Such processing involves the regasification, offloading, vaporization and distribution of the fluids, and is sometimes conducted at a maritime terminal. Crude oil, processed oil, petrochemicals such as isobutene, ethylene, propylene and the like, liquid hydrocarbons such as such as gasoline, lubricating oils and the like, compressed natural gas ("CNG"), natural gas liquids ("NGL"), i.e., combined butane, propane, hexane and the like, liquefied petroleum gas ("LPG"), such as butane, propane, hexane and the like, and so-called "gas-to-liquid" products ("GTL"), such as certain diesel oils, lubricating oils, paraffins and the like, as well as numerous other fluid products such as mineral and vegetable oils, NaOH, NaCl clarifiers, ethylenebenzene, benzene, raffinate and other liquid and gaseous chemicals, are also processed by various techniques in order to convert them into commercial products suitable for storage and/or distribution in the marketplace. When cryogenic fluids such as LNG are processed at maritime and land-base terminals, the processing always entails large capital investments, which are required by the need to provide expensive cryogenic storage tanks and vaporization equipment. Furthermore, demurrage and other charges associated with loading and offloading operations to and from the terminals burden the processing with additional costs. The offloading, handling and distribution of crude oil, processed oil, compressed natural gas, natural gas liquids, liquefied petroleum gas, petrochemicals and so-called gas-to-liquid products, as well as many other fluids, are also burdened with large capital investments and demurrage and other charges associated with the loading and offloading operations.

Technologies exist for generating LNG from natural gas and for processing and converting the LNG back to its gaseous form and distributing it to the market, as well as for handling and distributing crude oil and other petroleum products. See, for example, U.S. Pat. Nos. 4,033,735, 4,317,474, 5,129,759, 5,511,905, 5,657,643, 6,003,603, 6,298,671, 6,434,948 and 6,517,286. While the technologies described in these patents serve to address a number of individual product processing situations, none of them addresses the reception, processing, handling and distribution of a combination of these products from a central location under conditions that minimize the capital investments and operating costs required to carry out such reception, processing, handling and distribution operations.

A need exists to provide a safe and efficient method and system for receiving, processing, handling and distributing to the marketplace LNG and other fluid products at a centralized location under conditions that minimize the capital investments and operating costs required to carry out such operations. The present invention is directed toward providing such method and system.

SUMMARY OF THE INVENTION

The method and system of this invention center on the innovative concept of creating an integrated energy hub capable of bringing together all aspects of hydrocarbon and other fluid product movement under controlled conditions applicable to the reception, storage, processing, collection and transmission downstream. Input to the integrated energy hub can include natural gas and crude from a pipeline or a carrier, LNG from a carrier, CNG from a carrier, and carrier-regassed LNG, as well as other fluid products from a pipeline or a carrier. Storage can be above surface, in salt caverns or in subterranean formations and cavities, and include petroleum crude, natural gas, LPG, NGL, GTL and other fluids. Transmission downstream may be carried out by a vessel or other type of carrier and/or by means of a pipeline system. For incoming LNG arriving in a tanker, the method comprises offloading the LNG using the ship's pumps and storing the LNG in the energy hub surface holding tank, then pumping the LNG from the surface holding tank to the energy hub vaporizers. An intermediate step between the tank and the vaporizers may be used where the LNG is processed in liquid form to remove natural gas liquids (NGL) or to fractionate and separate liquefied petroleum gases (LPG). This may be done using conventional means such as fractionation columns and demethanizers. Alternatively, this step may be carried out by similar means between the vaporizers and pipelines, distribution or storage, and/or between the storage and distribution system.

Prior to entering the vaporizers, high pressure booster pumps raise the pressure of the LNG to either pipeline pressure, carrier pressure (CNG), cavern pressure or underground reservoir/formation pressure, depending on where the gas is to be delivered to. The gas leaving the vaporizers is stored in underground gas storage caverns or in underground reservoirs or, alternatively, it may be sent to shore via pipeline or distributed by other means such as loading on CNG carriers.

The method and system of this invention exhibits certain unique features that distinguish them from conventional technologies for the transportation, regasification, storage and distribution of hydrocarbons. For example, like in the case of conventional LNG terminals, the LNG that is handled by the method and system of this invention may be offloaded from a carrier ship into a surface tank. However, unlike the case of conventional LNG terminals, the surface holding tank of the method and system of this invention is used for certain unique purposes, and is not used for conventional bulk storage. The surface holding tank of the method and system of this invention is used to minimize carrier offload time, afford continuous operation of the energy hub vaporization stage and maintain the temperature of the vaporizer system at the desired level. The surface holding tank is a key component in economically offloading a carrier ship within a short time frame, and its use translates into substantial savings in the capital and operating costs associated with the vaporization equipment that is required to rapidly offload the ship. Once the ship is offloaded, the vaporization equipment will operate at a reduced rate utilizing the LNG from the tank to continue operations. Unlike the technologies used in standard LNG terminals, where the removal of the NGL takes place downstream from the vaporization step, the method and system of this invention allow the processing of the LNG for removing NGL in the liquid phase before entering the vaporizers. In this fashion, the gas may be stored in a salt cavern or subsea reservoir, if desired, and then sent to market distribution with minimal or no further processing. (Such processing is carried out by means of well known technologies.) The removal of the NGL can always take place downstream from the vaporization step and from the storage cavern if desired or required by the business distribution demand or by any other process operating reason. Unique to the offshore version of the energy hub concept is the benefit of being able to have salt domes and caverns located directly underneath, or in the immediate vicinity of, the offshore receiving platform or facility on which the surface holding tank and the vaporization equipment are installed. In addition, there is potential for some caverns to utilize oil or other liquids to displace gas from the caverns. Cavern storage allows more rapid offloading of carrier-regassed LNG and CNG offloaded from vessels.

BRIEF DESCRIPTION OF THE DRAWINGS

A clear understanding of the key features of the invention summarized above may be had by reference to the appended drawings, which illustrate the method of the invention, although it will be understood that such drawings depict preferred embodiments of the invention and, therefore, are not to be construed as limiting its scope with regard to other embodiments which the invention intends and is capable of contemplating. Accordingly.

DETAILED DESCRIPTION OF THE INVENTION

Figure 1:
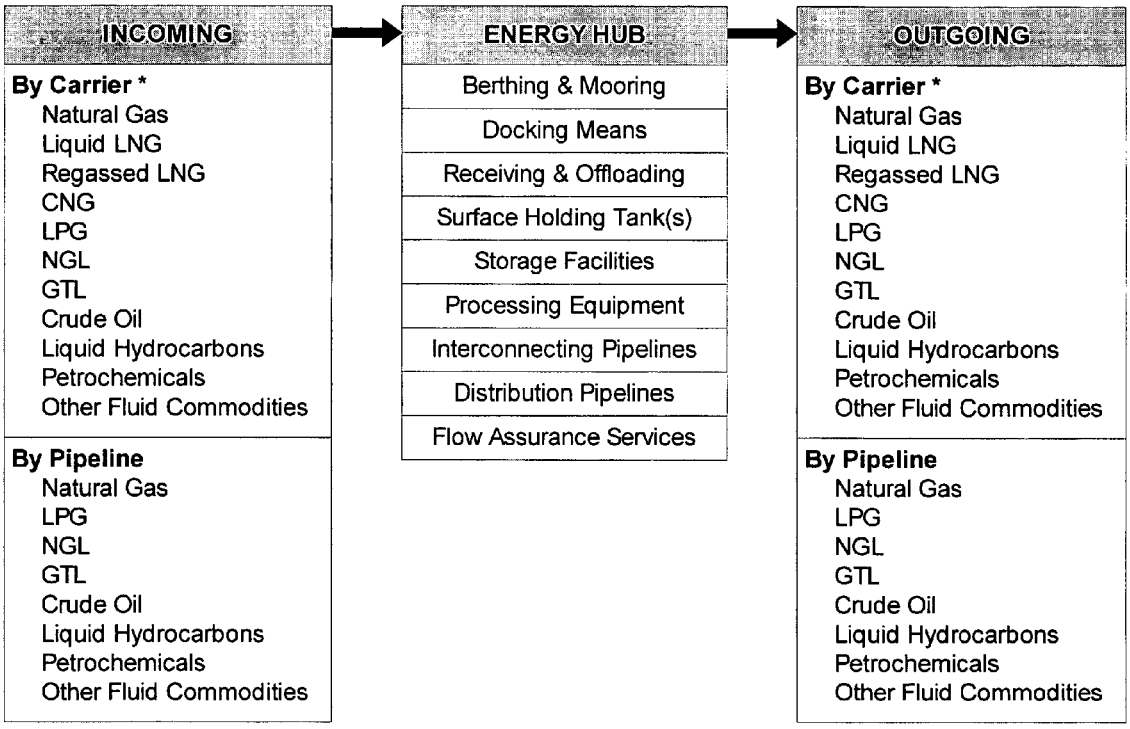
FIG. 1 is a general block diagram illustrating the variety of fluids that the energy hub facility of this invention is able to receive, process, store and/or deliver and the various destinations of the energy hub products.

Referring to FIG. 1, the variety of fluids that the energy hub facility of this invention is able to receive, process, store and/or deliver is shown on the left side of the block labeled "Energy Hub" under the heading "Incoming". As shown on FIG. 1, these fluids may arrive at the energy hub by carrier ships, boats, barges, tanker trucks, land transport and/or pipelines, and include natural gas, liquefied natural gas (LNG), regassed LNG, compressed natural gas (CNG), liquefied petroleum gas (LPG), natural gas liquids (NGL), gas-to-liquid products (GTL), crude oil (with or without mixed gas), liquid hydrocarbons, petrochemicals, and other fluid commodities, such as mineral and vegetable oils, NaOH, NaCl clarifiers, ethylenebenzene, benzene, raffinate and other liquid and gaseous chemicals. The fluids are handled and processed at the energy hub, which is equipped with means for berthing, mooring and docking ships, boats, barges, trucks and/or land transport, receiving and offloading facilities, at least one surface holding tank, storage facilities (such as tanks, salt caverns and/or subterranean cavities and reservoirs), processing equipment (such as vaporizers, product blending and NGL removing equipment), interconnecting pipelines, distribution pipelines and flow assurance service facilities. The variety of products that the energy hub is able to store and/or deliver is shown on the right side of the block labeled "Energy Hub" under the heading "Outgoing". The outgoing products include natural gas, liquefied natural gas (LNG), compressed natural gas (CNG), liquefied petroleum gas (LPG), natural gas liquids (NGL), gas-to-liquid products (GTL), crude oil (with or without mixed gas), liquid hydrocarbons, petrochemicals, and other fluid commodities, such as mineral and vegetable oils, NaOH, NaCl clarifiers, ethylenebenzene, benzene, raffinate and other liquid and gaseous chemicals.

Significant cost savings result from using the method and system of this invention as capital expenditures are reduced or eliminated for each facility and product handled by the energy hub by utilizing shared facilities and infrastructure. Operating costs similarly are reduced or eliminated for each facility and product handled by the energy hub by sharing labor and maintenance, as well as sharing the operating expenses associated with these same facilities and infrastructure. One of the most significant features of the energy hub method and system of this invention is the capturing of these conventional, generally isolated techniques into a single operating facility or entity, thereby creating much higher value and reduced costs.

Figure 2:
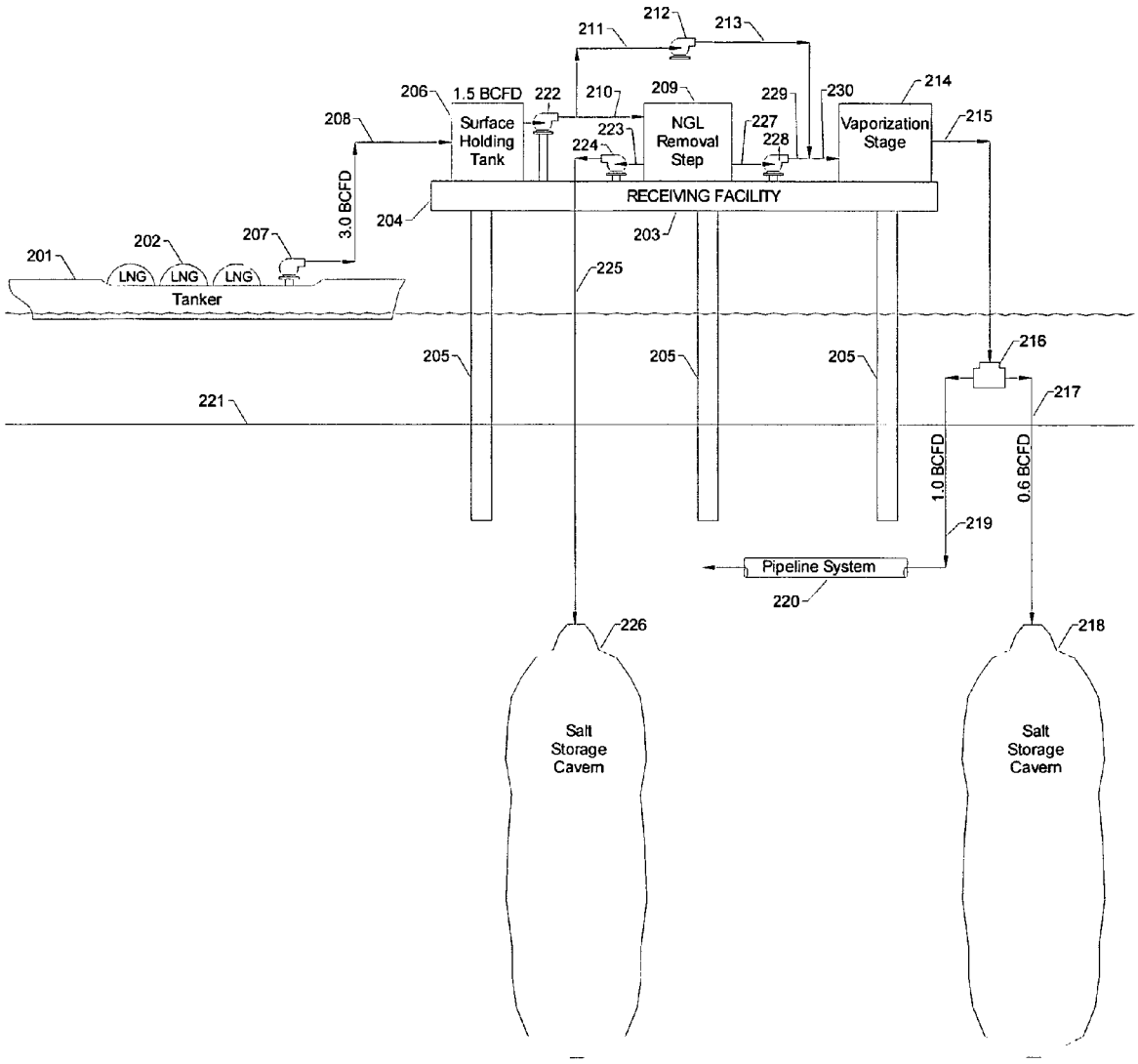
FIG. 2 is a schematic diagram of a preferred embodiment of this invention illustrating one of the many manners in which the method and system of the invention are capable of bringing together all aspects of hydrocarbon movement (in this case LNG movement) under controlled conditions in an offshore marine energy hub, including reception, offloading, holding, processing, collection and transmission downstream.

Referring to FIG. 2, cryogenic fluid tanker 201, equipped with cryogenic tanks 202 and cryogenic pumps 207, is used to transport LNG at about −250° F. and 1-5 psig from a LNG production source to the receiving facility 203 of the energy hub of this invention. Receiving facility 203 comprises a platform 204 supported by piles 205 imbedded in the bottom of the sea 221. From tanker 201, the LNG is pumped into surface holding tank 206 by means of cryogenic pumps 207 located aboard tanker 201. (Cryogenic pumps 207 may also be located on platform 204). A "head" pressure of about 100 psig is used to pump LNG 208 into surface holding tank 206, which is equipped with cryogenic means to maintain the temperature of the LNG at about −250° F. and its pressure at about 1-5 psig.

From surface holding tank 206, a portion 210 (about 50%) of the LNG, at about −250° F. and 200 psig is pumped into NGL removal step 209 by means of pump 222. In NGL removal step 209, natural gas liquids 223, such as butane, propane, pentane, hexane and heptane, are removed, pressurized and warmed to about 40° F. Booster pump 224 is used to boost the pressure of the NGL to cavern pressure (about 1,500 psig) and the further pressurized NGL 225 is then sent to be stored, e.g., in subterranean salt cavern 226 at about 50-90° F. and 1,500 psig, for subsequent sale to customers. The removal of the NGL is carried out by conventional means for the removal of natural gas liquids from LNG. Such conventional means include well known technologies such as the use of fractionation columns and demethanizers, available from various sources and as described in publications such as the GPSA Engineering Data Book, 11$^{th}$ Edition, 1998, published by the Gas Processors Supplier Association, of Tulsa, Okla. The removal of the NGL reduces the BTU value of the final gas product obtained from the LNG that is being processed. (The BTU value is a measure of the amount of heat, measured in BTUs, that is generated by the burning of a cubic foot of gas. If the BTU value exceeds certain commercial standards, the burning of the gas product may adversely affect the equipment that is used to burn the gas.) After removal of the NGL, the processed (NGL-depleted) LNG 227 is sent to the high-pressure booster pumps 228, to be pumped as (dense phase) fluid 229, at a pressure of about 2,200 psig and a temperature of about −250° F., to the vaporization stage 214. Another portion 211 (about 50%) of the LNG from surface holding tank 206, at about −250° F. and 200 psig, bypasses the NGL removal step and is pumped by means of high-pressure booster pumps 212, as (dense phase) fluid 213, at a pressure of about 2,200 psig and a temperature of about −250° F., into vaporization stage 214. (Depending on the BTU value and the volume of the LNG exiting surface holding tank 206, NGL removal step 209 may be completely bypassed, or the relative magnitudes of portions 210 and 211 may be adjusted to provide the desired BTU value of the LNG going into vaporization stage 214.) Prior to entering the vaporization stage 214, the unprocessed LNG stream 213 and the processed LNG stream 229 are combined as single LNG stream 230 at about −250° F. and 2,200 psig.

Vaporization stage 214 involves the heating of the cold LNG fluid 230 to convert it to (dense phase) vapor 215 at a pressure of about 2,200 psig and a temperature of about 40° F. (The actual operating pressure may range anywhere from about 700 to about 2,400 psig; and the actual operating temperature may range anywhere from about 0° F. to about 95° F.) As a result of the heating that takes place in vaporization stage 214, (dense phase) vapor 215 is a warmed fluid capable of being handled in conventional-material equipment and sufficiently warm to be delivered by conventional pipelines and/or stored in conventional manner in salt caverns or other subterranean reservoirs. The vaporization of cold LNG fluid 230 may be carried out by means of submerged vaporization techniques, such as those used in the system described in Appendix A of the publication "*LNG Receiving and Gas Regasification Terminals*", by Ram R. Tarakad, Ph. D., P.E., © 2000 Zeus Development Corporation, of Houston, Tex. In a preferred embodiment, the source of heat for the vaporization stage is seawater originating directly from the sea. The water used as the source of heat could also originate from other sources, including underground formations. Vaporization may also be effected by means of other conventional vaporization techniques such as those that employ so-called open rack vaporizers, remotely heated vaporizers, integral heated vaporizers, intermediate fluid vaporizers, steam heated vaporizers and the like.

(Dense phase) vapor 215 flows into flow regulator 216, where it flows through an arrangement of valves in order to be separated into gas stream 217, which is sent to underground salt cavern 218, and gas stream 219, which is sent to the gas marketplace via pipeline system 220. Underground salt cavern 218 may be what is known as an "uncompensated storage cavern", i.e., a cavern where no brine, water or any other liquid is either displaced by the incoming gas when the (dense phase) vaporized LNG is injected into the cavern or used to displace the stored hydrocarbon out of the cavern. High-pressure booster pumps 212 are conveniently adjusted and operated so as to provide controlled underground cavern pressure (at least about 700 psig and up to about 3,000 psig), or pipeline pressure (at least about 500 psig and up to about 1,500 psig), depending on the specific desired mode of gas storage and distribution. In the illustration shown in FIG. 2, receiving facility 203 is an offshore platform; however, receiving facility 203 may also be an onshore terminal, or a floating facility, including floating ships, buoys and single-point moorings, or in general, any other fixed or floating structure equipped to allow the berthing of a carrier ship and receive LNG.

The method and system of the invention depicted in FIG. 2 afford significant cost savings in vaporization and other equipment, which come at the expense of very limited volume of surface holding tank capacity. Conventional methods and systems that employ surface storage need large volumes of cryogenic surface storage, requiring typically between five and ten times as much surface storage tank capacity as the tank capacity required of the surface holding tank of the method and system of this invention. Thus, for a nominal-size 1.0-billion-cubic-foot conventional facility, enough tanks need to be installed to provide about 16 billion cubic feet equivalent ("BCFE") of gas surface storage. By comparison, a nominal-size 1.0-billion-cubic-foot energy hub facility requires only 1.5 BCFE of surface holding tank capacity. Conventional methods and systems that employ no surface storage tanks at all (such as the Bishop et al. system described in Published U.S. patent application Ser. No. 10/246,954, now U.S. Pat. No. 6,739,140) require the use of increased amounts of vaporizer capacity. For example, for a nominal-size 1.0-BCFE conventional facility with no surface storage tanks, enough vaporization equipment needs to be installed to provide about 3.0 billion cubic feet per day ("BCFD") of vaporizer capacity. By comparison, a nominal 1.0-BCF energy hub facility requires only 1.6 BCFD of vaporizer capacity. This is a significant difference in the capital and operating cost of the facility given the very expensive nature of the commercially available vaporization equipment. These comparisons are illustrated in Table 1 below.

Table 1 illustrates one of the advantages of the method of this invention when compared with those conventional technologies that store LNG in surface storage tanks, as well as when compared with those conventional technologies that store no LNG in surface storage tanks. The facility size in all three of the methods referenced in Table 1 is a nominal 1.0 BCF. The LNG surface holding capacity shown for the energy hub (1.5 BCFE) is the volume capacity of the surface holding tank depicted in FIG. 2. More than one surface holding tank may be used in the energy hub embodiment depicted in FIG. 2 while still requiring only 1.5 BCFE of volume capacity for the surface holding tanks. Different variations of the energy hubs concept may require differing volumes of surface holding tank capacity, and each such variation may be sized according to the specific needs of each facility, however, the cost of each facility will be significantly reduced by the application of the energy hub concept and the proper sizing of the surface holding tank.

Figure 3:
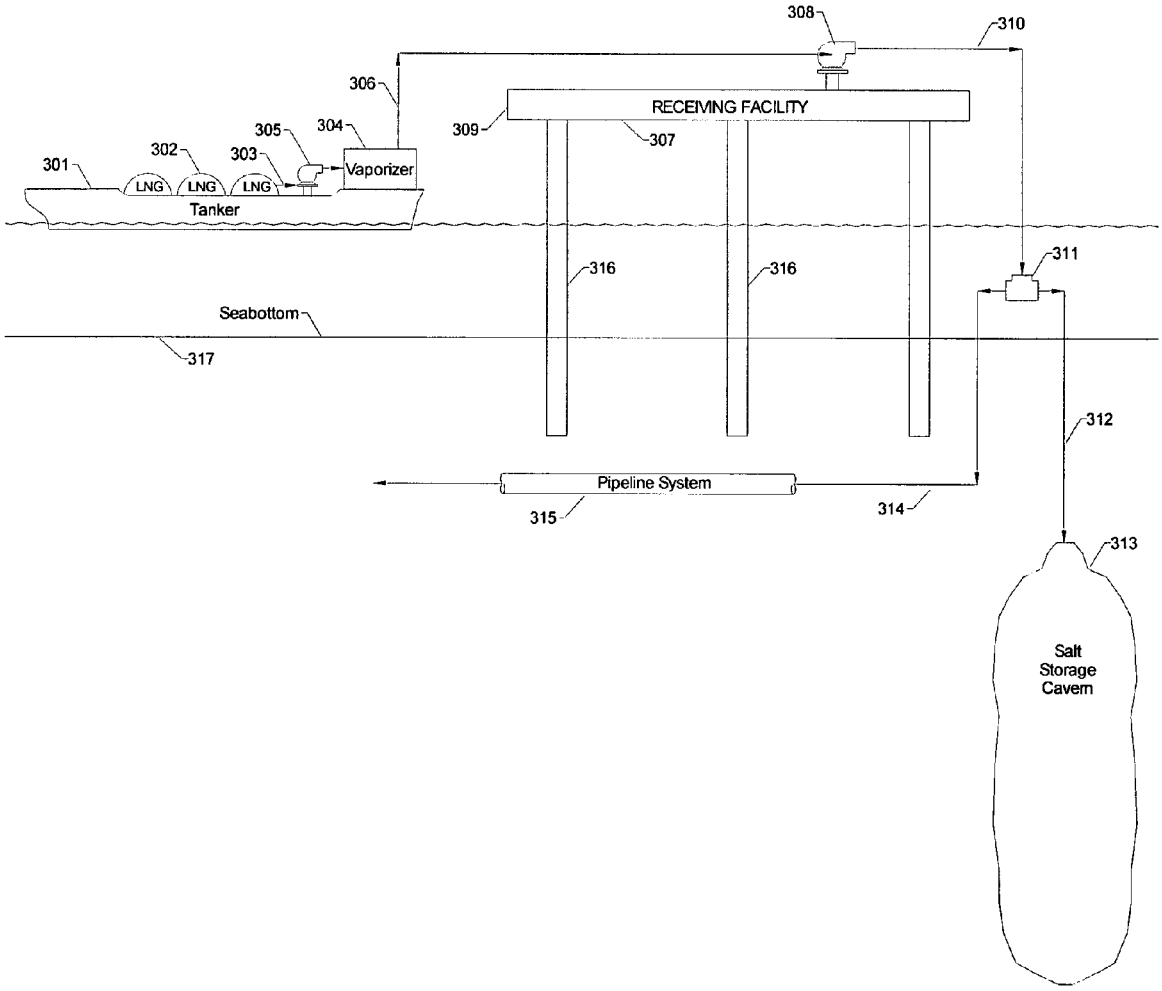
FIG. 3 is a schematic diagram of another preferred embodiment of the invention illustrating another manner in which the method and system of the invention are capable of bringing together all aspects of hydrocarbon movement under controlled conditions in a marine energy hub, including reception, holding, collection and transmission downstream.

In this fashion, a "regas ship" such as cryogenic tanker 301 can be rapidly offloaded, allowing the ship to have shorter round trip duration (ship turnaround time) and providing greater return on the capital and other costs invested in the fabrication and operation of the ships. (The capital costs for these tank ships are very high, and their return on investment is directly tied to the time in which the ships are able to make round trips between the liquefaction plant and the LNG receiving facility.) Also, when the energy hub method and system depicted in FIG. 3 are used, the revenues from sales of gas are higher due to minimal impact on the markets. This embodiment also allows all of the LNG cargo to be offloaded safely and quickly without the need to offload large volumes of gas into pipelines, which could cause severe restrictions on offloading time and therefore increase ship turnaround time.

TABLE 1

| METHOD | TOTAL SHIP TURNAROUND TIME (HOURS) | OFF-LOAD TIME (HOURS) | SHIP-TO-TANK OFF-LOAD RATE (BCFED) | FACILITY SIZE (BCF) | LNG SURFACE HOLDING/ STORAGE (BCFE) | VAPORIZER CAPACITY (BCFD) | RATE OF GAS SENT TO PIPELINE (BCFD) |
|---|---|---|---|---|---|---|---|
| TYPICAL ENERGY HUB* | OFFSHORE 28 | 24 | 3.0 | 1.0 | 1.5** | 1.6 | 1.0 |
| CONVENTIONAL (WITH SURFACE STORAGE) | ONSHORE 36 | 12 | 6.0 | 1.0 | 16 | 1.0 | 1.0 |
| CONVENTIONAL (WITHOUT SURFACE STORAGE) | OFFSHORE/ ONSHORE 28-48 | 24 | 3.0 | 1.0 | 0 | 3.0 | 1.0 |

*Energy hub component sizes may differ, depending on the specific requirements of each energy hub facility.
Surface holding tank Another embodiment of the energy hub concept of the present invention which is also capable of bringing together all aspects of hydrocarbon movement is shown in FIG. 3, where cryogenic fluid tanker 301, equipped with cryogenic tanks 302, carrying LNG 303 at a temperature of about −250° F. and a pressure of about 1-5 psig, is equipped with pumping means 305 and vaporization equipment 304 for converting LNG 303 to regassed fluid 306 onboard the vessel. Warmed regassed fluid 306, at a temperature of about 90° F. and a pressure of between about 200 and 1,500 psig, is transferred to high-pressure booster pumps (or compressors) 308 on receiving facility 309. Receiving facility 309 comprises a platform 307 supported by piles 316 imbedded in seabottom 317. High-pressure booster pumps 308 increase the pressure of the gas to anywhere between about 1,500 and 3,000 psig, depending on the specifications required for the desired mode of operation, e.g., cavern pressure, market pipeline pressure, etc., and send the gas, as gas stream 310, through a pipeline and into flow regulator 311, where the gas flows through an arrangement of valves and is separated into gas stream 312, which is sent to underground salt cavern 313, and gas stream 314, which is sent to the gas marketplace via pipeline system 315. (Stream 312 may also be stored in any other type of subterranean formation, cavity or reservoir.) Vaporization equipment 304 may be sized to standard specifications, or it may be oversized, so long as it affords the rapid vaporization of LNG 303 to regassed fluid 306 onboard the vessel. In the illustration shown in FIG. 3, receiving facility 309 is an offshore platform; however, receiving facility 309 may also be an onshore terminal, or a floating facility, including floating ships, buoys and single-point moorings, or in general, any other fixed or floating structure equipped to allow the berthing of a carrier ship and receive regassed LNG. By judiciously adjusting the gas flow in and out of flow regulator 311**, the regassed LNG can be delivered to the marketplace via pipeline networks or any other means at measured rates that will not disrupt the markets or the pipelines.

Figure 4:
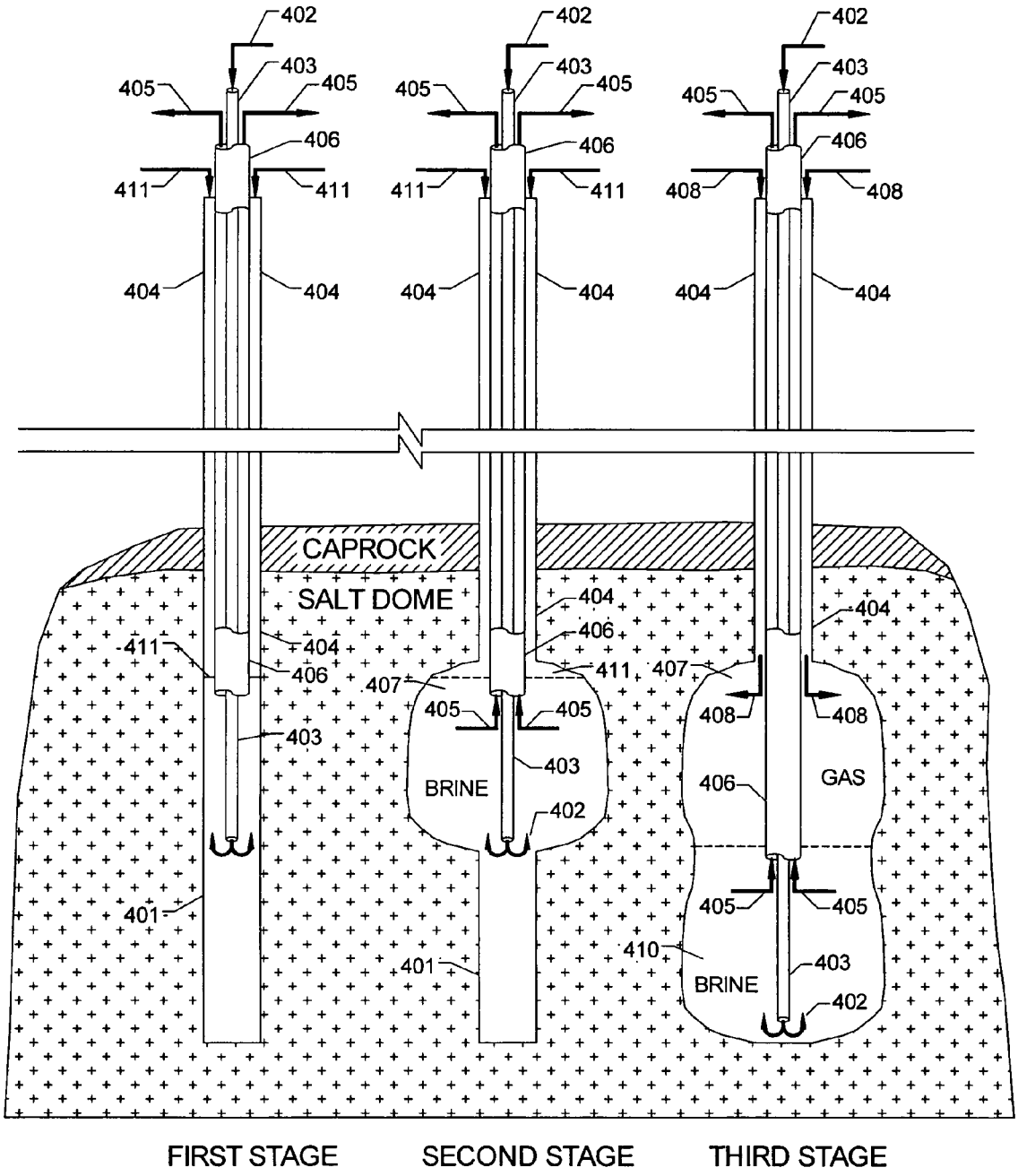
FIG. 4 shows a schematic diagram of the manner in which a subterranean salt cavern may be developed and used while simultaneously storing compressed vaporized LNG in accordance with the method of the present invention.

Providing a suitable underground salt cavern for the storage of the regassed LNG is an important component of the energy hub embodiment that uses such underground salt caverns. Accordingly, another unique feature of the method and system of this invention is the fact that the underground salt cavern may be provided using solution mining techniques, and the regassed LNG (originating, for example, from the energy hub's vaporization system or from a carrier) can be stored in the cavern while the cavern is being solution mined. This feature is illustrated in FIG. 4.

Utilizing salt caverns and other subterranean storage reservoirs can significantly reduce the offloading time for carriers while minimizing risk of disruption to the gas pipelines or markets. The time required to develop caverns for receiving vaporized LNG from any of the embodiments of this invention can significantly impact the availability of a LNG receiving terminal or a carrier-regassed LNG receiving facility to become operational. Therefore, as shown in the First Stage diagram of FIG. 4, a well 401 is first drilled into a naturally occurring salt formation and the initial development of the cavern is commenced by a solution mining technique where the formation, located between about 500 and 3,000 feet below the surface of the earth, is mined of salt with fresh or raw seawater 402, which is fed through pipe 403, set inside casing 404 in a hanging pipe string. The leaching of the salt results in the extraction of brine 405, which exits through brine pipe 406, and contains anywhere between about 6 and 26% sodium chloride. (The normal salt content of seawater is about 3% sodium chloride.) A cavern-roof-protecting blanket material 411, fed through casing 404, is placed and maintained in the top of the well. The positions of the hanging strings in the well are generally adjustable but may be fixed. As depicted in this First Stage diagram, the hanging string is initially positioned to allow rapid development of the upper section of the salt cavern for fluid storage. Such rapid development is illustrated in the Second Stage diagram of FIG. 4, where cavern upper section 407 is created by the leaching action of water 402, injected through pipe 403, inside casing 404. At this point, brine 405 is returned through brine pipe 406 and properly disposed of. The cavern-roof-protecting blanket material 411, fed through casing 404, is maintained in the top of the cavern until the upper section 407 reaches design dimensions. By leaching the top and the bottom of the cavern sequentially and avoiding doing it simultaneously, the leaching of upper section 407 is one-and-one-half-to-three times faster than what it would be if the entire cavern was being leached at the same time, and the upper section of the cavern becomes available to store vaporized LNG at a much earlier time. When the upper section of the cavern has reached design dimensions, the positions of the hanging string are adjusted. The hanging string is then positioned, i.e., lowered, so as to cause the leaching of a cavern bottom section 410, as depicted in the Third Stage diagram of FIG. 4, while simultaneously injecting vaporized LNG 408 in cavern upper section 407. Thus, vaporized LNG 408 is injected through casing 404 into cavern upper section 407 to a pre-determined level. The gas, being less dense than the brine, is contained and accumulates inside cavern upper section 407, above the brine inside cavern lower section 410. Water 402 (fresh or seawater) continues to be injected into the cavern through pipe 403 in order to dissolve more salt so as to create and enlarge cavern bottom section 410. Newly formed brine 405 is returned through brine pipe 406 and properly disposed of. Again, by leaching the top of the cavern first and then leaching the bottom, the method of this invention causes the leaching of cavern bottom section 410 to take place one-and-one-half-to-three times faster than what it would take place if the entire cavern was being leached at the same time. When the bottom section of the cavern reaches the desired design dimensions, additional volumes of vaporized LNG are injected through casing 404 and the entire new cavern may then be utilized for storing the gas. The resulting cavern is particularly suitable for use in the storage of the fluids handled and distributed by the method and system of this invention because the cavern walls are essentially impermeable and the cavern contains the fluids quite satisfactorily. In addition to or instead of the exact arrangement illustrated in FIG. 4, various other arrangements of hanging strings and solution mining equipment may be used for carrying out the energy hub method of simultaneous cavern development and fluid storage. Thus, for example, the piping system used to inject the solution mining water and bleed the resulting brine may be inversed so that the mining water is injected through the annulus of a pipe that surrounds a centric pipe through which the resulting brine is made to exit; or the vaporized LNG may be injected through a separate hanging string. Alternatively, the leaching scenario may be reversed to leach a bottom section first and store a heavy fluid in the bottom section while the upper section is being leached. In any case, the vaporized LNG may be transported from the storage cavern to the marketplace via pipeline networks or any other suitable means; and LNG ships with onboard vaporizing systems may be rapidly offloaded, allowing more round trips and greater return on the capital invested.

The energy hub method of simultaneous cavern development and fluid storage illustrated in FIG. 4 has been described with reference to the handling, storage and distribution of regassed LNG, however, the simultaneous cavern development and fluid storage energy hub method may also be applied to the handling, storage and distribution of other gases, crude oil, liquid hydrocarbons, petrochemicals and many other fluids as set forth above.

While the present invention has been described in terms of particular embodiments and applications, in both summarized and detailed forms, it is not intended that these descriptions in any way limit its scope to any such embodiments and applications, and it will be understood that many substitutions, changes and variations in the described embodiments, applications and details of the method and system illustrated herein and of their operation can be made by those skilled in the art without departing from the spirit of this invention.

We claim:

1. An energy hub system for the reception, processing, handling and marketplace distribution of hydrocarbons and other fluids, comprising:

(a) facilities for receiving and offloading hydrocarbons or other fluids;

(b) at least one surface holding tank, connectable to said facilities for receiving and offloading hydrocarbons or other fluids and capable of holding received and offloaded hydrocarbons or other fluids;

(c) means for vaporizing said received and offloaded hydrocarbons or other fluids;

(d) first pumping means, connectable to said at least one surface holding tank and capable of flowing said hydrocarbons or other fluids into said vaporization means;

(e) distribution means, connectable to said vaporization means and capable of directing said hydrocarbons or other fluids to the marketplace;

(f) an underground storage facility, connectable to said vaporization means and to said distribution means; and (g) second pumping means, connectable to said vaporization means and capable of flowing said hydrocarbons or other fluids from said vaporization means into said distribution means and underground storage facility, wherein said at least one surface holding tank is used to minimize offload time and wherein the volume capacity of said at least one surface holding tank, in BCFE, is less than the per-day offloading rate, in BCFED, at which said hydrocarbons or other fluids are offloaded and received by said facilities for receiving and offloading them.

2. The energy hub system of claim 1, wherein said facilities for receiving and offloading hydrocarbons or other fluids comprise berthing and mooring means, loading arms, hoses, buoys and/or single point moorings.

3. The energy hub system of claim 1, wherein the volume capacity of said at least one surface holding tank is less than about 4 BCFE.

4. The energy hub system of claim 1, wherein only one surface holding tank is used.

5. The energy hub system of claim 1, wherein said vaporization means utilize seawater as the source of heat for the vaporization of said hydrocarbons or other fluids.

6. The energy hub system of claim 1, wherein said vaporization means comprise conventional means for vaporizing hydrocarbons and other fluids, said conventional means selected from the group consisting of open rack vaporizers, remotely heated vaporizers, integral heated vaporizers, intermediate fluid vaporizers, steam heated vaporizers, shell-and-tube heat exchangers and air-exchange heaters.

7. The energy hub system of claim 1, wherein said underground storage facility comprises at least one salt storage cavern.

8. The energy hub system of claim 1, wherein said second pumping means comprise at least one high-pressure booster pump located upstream from said vaporization means and operated so as to provide controlled underground pressure inside said underground storage facility.

9. The energy hub system of claim 1, wherein the fluid received, processed, handled and distributed is a hydrocarbon, and further comprising means for removing natural gas liquids from said hydrocarbon, said means located downstream from said at least one surface holding tank.

10. The energy hub system of claim 1, wherein the fluid received, processed, handled and distributed is a fluid selected from the group consisting of natural gas, liquefied natural gas, regassed LNG, compressed natural gas, liquefied petroleum gas, natural gas liquid, gas-to-liquid product, crude oil (with or without mixed gas), a liquid hydrocarbon and a petrochemical.

11. The energy hub system of claim 1, wherein the fluid received, processed, handled and distributed is a fluid selected from the group consisting of a mineral oil, a vegetable oil, sodium hydroxide, sodium chloride, a clarifier, ethylenebenzene, benzene and a raffinate.

12. The energy hub system of claim 1, wherein said hydrocarbons or other fluids arrive at said receiving and offloading facilities by pipeline.

13. The energy hub system of claim 1, wherein said hydrocarbons or other fluids arrive at said receiving and offloading facilities by a carrier selected from the group consisting of a marine vessel, a ship, a boat, a barge, a tank truck and rail transport.

14. The energy hub system of claim 1, wherein said underground storage facility comprises at least one salt storage cavern created by the simultaneous-underground-cavern-development-and-fluid-storage -solution method.

15. An energy hub system for the reception, processing, handling and marketplace distribution of hydrocarbons, comprising:

(a) facilities for receiving and offloading hydrocarbons;
(b) a surface holding tank, connectable to said facilities for receiving and offloading hydrocarbons and capable of holding received and offloaded hydrocarbons;
(c) conventional means for vaporizing hydrocarbons, said conventional means selected from the group consisting of open rack vaporizers, remotely heated vaporizers, integral heated vaporizers, intermediate fluid vaporizers, steam heated vaporizers, shell-and-tube heat exchangers and air-exchange heaters;
(d) first pumping means, connectable to said surface holding tank and capable of flowing said hydrocarbons into said conventional means for vaporizing hydrocarbons;
(e) a pipeline system, connectable to said conventional means for vaporizing hydrocarbons and capable of directing vaporized hydrocarbons to the marketplace;
(f) at least one underground salt storage cavern, connectable to said conventional vaporization means and to said pipeline system;
(g) second pumping means, connectable to said conventional vaporization means and capable of flowing vaporized hydrocarbons from said conventional vaporization means into said pipeline system and said at least one underground salt storage cavern; and
(h) valve means, connectable to said conventional vaporization means, for controlling and directing the flow of vaporized hydrocarbons from said conventional vaporization means between said pipeline system and said at least one underground salt storage cavern, wherein said surface holding tank is used to minimize offload time and wherein the volume capacity of said surface holding tank, in BCFE, is less than the per-day offloading rate, in BCFED, at which said hydrocarbons are offloaded and received by said facilities for receiving and offloading them.

16. The energy hub system of claim 15, wherein the volume capacity of said surface holding tank is less than about 4 BCFE.

17. The energy hub system of claim 15, wherein said second pumping means comprise at least one high-pressure booster pump located upstream from said conventional means for vaporizing hydrocarbons and operated so as to provide controlled underground pressure inside said at least one underground salt storage cavern.

18. The energy hub system of claim 15, further comprising means for removing natural gas liquids from said received and offloaded hydrocarbons, said means located downstream from said surface holding tank.

19. The energy hub system of claim 15, wherein said hydrocarbons arrive at said receiving and offloading facilities by pipeline.

20. The energy hub system of claim 15, wherein said hydrocarbons arrive at said receiving and offloading facilities by a carrier selected from the group consisting of a marine vessel, a ship, a boat, a barge, a tank truck and rail transport.

21. A method for the reception, processing, handling and marketplace distribution of hydrocarbons and other fluids, said method comprising:

(a) receiving and offloading hydrocarbons or other fluids;
(b) flowing the received and offloaded hydrocarbons or other fluids into at least one surface holding tank;
(c) pumping the received and offloaded hydrocarbons or other fluids from said at least one surface holding tank into a vaporizer and subjecting them to vaporization;
(d) directing a first portion of the vaporized hydrocarbons or other fluids to the marketplace by means of a distribution system;
(e) directing a second portion of the vaporized hydrocarbons or other fluids to an underground storage facility wherefrom they may be subsequently directed to the marketplace by means of a distribution system; and
(f) storing said second portion of the vaporized hydrocarbons or other fluids in said underground storage facility, wherein said at least one surface holding tank is used to minimize offload time and wherein the volume capacity of said at least one surface holding tank, in BCFE, is less than the per-day offloading rate, in BCFED, at which said hydrocarbons or other fluids are offloaded and received by said facilities for receiving and offloading them.

22. The method of claim 21, wherein said receiving and offloading of the hydrocarbons or other fluids are carried out by means of berthing and mooring means, loading arms, hoses, buoys and/or single point moorings.

23. The method of claim 21, wherein the volume capacity of said at least one surface holding tank is less than about 4 BCFE.

24. The method of claim 21, wherein only one surface holding tank is used.

25. The method of claim 21, wherein said vaporizer utilizes seawater as the source of heat for the vaporization of said hydrocarbons or other fluids.

26. The method of claim 21, wherein said vaporizer is a conventional vaporizer selected from the group consisting of open rack vaporizers, remotely heated vaporizers, integral heated vaporizers, intermediate fluid vaporizers, steam heated vaporizers, shell-and-tube heat exchangers and air-exchange heaters.

27. The method of claim 21, wherein said underground storage facility comprises at least one salt storage cavern.

28. The method of claim 21, wherein said directing of said second portion of the vaporized hydrocarbons or other fluids to an underground storage facility is carried out by means of at least one high-pressure booster pump located upstream from said vaporizer and operated so as to provide controlled underground pressure inside said underground storage facility.

29. The method of claim 21, wherein the fluid received, processed, handled and distributed is a hydrocarbon, and further comprising removing natural gas liquids from said hydrocarbon downstream from said at least one surface holding tank.

30. The method of claim 21, wherein the fluid received, processed, handled and distributed is a fluid selected from the group consisting of natural gas, liquefied natural gas, regassed LNG, compressed natural gas, liquefied petroleum gas, natural gas liquid, gas-to-liquid product, crude oil (with or without mixed gas), a liquid hydrocarbon and a petrochemical.

31. The method of claim 21, wherein the fluid received, processed, handled and distributed is a fluid selected from the group consisting of a mineral oil, a vegetable oil, sodium hydroxide, sodium chloride, a clarifier, ethylene benzene, benzene and a raffinate.

32. The method of claim 21, wherein said hydrocarbons or other fluids arrive at receiving and offloading facilities by pipeline.

33. The method of claim 21, wherein said hydrocarbons or other fluids arrive at receiving and offloading facilities by a carrier selected from the group consisting of a marine vessel, a ship, a boat, a barge, a tank truck and rail transport.

34. The method of claim 21, wherein said underground storage facility comprises at least one salt storage cavern created by the simultaneous-underground-cavern-development-and-fluid-storage-solution-mining method.

35. A method for the reception, processing, handling and marketplace distribution of hydrocarbons, said method comprising:

(a) receiving and offloading hydrocarbons;
(b) flowing the received and offloaded hydrocarbons into a surface holding tank;
(c) pumping the received and offloaded hydrocarbons from said surface holding tank into a conventional vaporizer and subjecting them to vaporization, said conventional vaporizer selected from the group consisting of open rack vaporizers, remotely heated vaporizers, integral heated vaporizers, intermediate fluid vaporizers, steam heated vaporizers, shell-and-tube heat exchangers and air-exchange heaters;
(d) directing a first portion of the vaporized hydrocarbons to the marketplace by means of a pipeline system;
(e) directing a second portion of the vaporized hydrocarbons to at least one underground salt storage cavern wherefrom they may be subsequently directed to the marketplace by means of a pipeline system; and
(f) storing said second portion of the vaporized hydrocarbons in said at least one underground salt storage cavern, wherein said surface holding tank is used to minimize offload time and wherein the volume capacity of said surface holding tank, in BCFE, is less than the per-day offloading rate, in BCFED, at which said hydrocarbons are offloaded and received by said facilities for receiving and offloading them.

36. The method of claim 35, wherein the volume capacity of said surface holding tank is less than about 4 BCFE.

37. The method of claim 35, wherein said directing of said second portion of the vaporized hydrocarbons to at least one underground salt storage cavern is carried out by means of at least one high-pressure booster pump located upstream from said conventional vaporizer and operated so as to provide controlled underground pressure inside said at least one underground salt storage cavern.

38. The method of claim 35, further comprising removing natural gas liquids from said hydrocarbons downstream from said surface holding tank.

39. The method of claim 35, wherein said hydrocarbons arrive at receiving and offloading facilities by pipeline.

40. The method of claim 35, wherein said hydrocarbons arrive at receiving and offloading facilities by a carrier selected from the group consisting of a marine vessel, a ship, a boat, a barge, a tank truck and rail transport.

41. A method for the reception, processing, handling and marketplace distribution of a hydrocarbon or other fluid transported in cryogenic state in a carrier such as a marine vessel, barge, tank truck or rail car, said method comprising:

(a) providing a conventional vaporizer aboard the carrier, said conventional vaporizer selected from the group consisting of open rack vaporizers, remotely heated vaporizers, integral heated vaporizers, intermediate fluid vaporizers, steam heated vaporizers, shell-and-tube heat exchangers and air-exchange heaters;
(b) pumping said hydrocarbon or other fluid in cryogenic state into said conventional vaporizer and subjecting it to vaporization so as to vaporize and convert it to a gas;
(c) transferring said vaporized gas to the intake of at least one high-pressure booster pump located downstream from said conventional vaporizer on a receiving facility;
(d) increasing the pressure of said vaporized gas by means of said at least one high-pressure booster pump;
(e) separating the increased-pressure vaporized gas by means of a flow regulator into a pressurized gas first portion and a pressurized gas second portion;
(f) directing said separated pressurized gas first portion to the marketplace by means of a pipeline system;
(g) directing said separated pressurized gas second portion to at least one underground salt storage cavern wherefrom it may be subsequently directed to the marketplace by means of a distribution system; and
(h) storing said pressurized gas second portion in said at least one underground salt storage cavern, wherein said directing of the separated pressurized gas first portion to the marketplace and said directing of the separated pressurized gas second portion to at least one underground salt storage cavern are carried out sequentially on an as-needed basis.

42. A method for the reception, processing, handling and marketplace distribution of hydrocarbons and other fluids, said method comprising:

(a) receiving and offloading hydrocarbons or other fluids;
(b) flowing the received and offloaded hydrocarbons or other fluids into at least one surface holding tank;
(c) feeding the received and offloaded hydrocarbons or other fluids from said at least one surface holding tank into a processing facility and processing them in said facility;

(d) directing a first portion of the processed hydrocarbons or other fluids to the marketplace by means of a distribution system;

(e) directing a second portion of the processed hydrocarbons or other fluids to an underground storage facility wherefrom they may be subsequently directed to the marketplace by means of a distribution system; and (f) storing said second portion of the processed hydrocarbons or other fluids in said underground storage facility, wherein said at least one surface holding tank is used to minimize offload time and wherein the volume capacity of said at least one surface holding tank, in BCFE, is less than the per-day offloading rate, in BCFED, at which said hydrocarbons or other fluids are offloaded and received by said facilities for receiving and offloading them.

43. The method of claim 42, wherein the volume capacity of said at least one surface holding tank is less than about 4 BCFE.

44. The method of claim 42, wherein only one surface holding tank is used.

45. The method of claim 42, wherein said processing comprises one or more unit operations selected from the group consisting of vaporization, fractionation, product blending, NGL removal, distillation, sweetening and odorizing.

46. A method for the reception, processing, handling and marketplace distribution of LNG and CNG from an energy hub, said method comprising:

(a) receiving and offloading LNG or CNG at receiving and offloading facilities;

(b) feeding the received and offloaded LNG or CNG from said receiving and offloading facilities into a processing facility and processing them in said facility;

(c) directing a first portion of the processed LNG or CNG to the marketplace by means of a distribution system;

(d) directing a second portion of the processed LNG or CNG to an underground storage facility wherefrom they may be subsequently directed to the marketplace by means of a distribution system; and (e) storing said second portion of the processed LNG or CNG in said underground storage facility.

47. The method of claim 46, wherein said processing comprises one or more unit operations selected from the group consisting of vaporization, fractionation, product blending, NGL removal, distillation, sweetening and odorizing.

48. The method of claim 46, wherein said LNG or CNG arrive at said receiving and offloading facilities by pipeline.

49. The method of claim 46, wherein said LNG or CNG arrive at said receiving and offloading facilities by a carrier selected from the group consisting of a marine vessel, a ship, a boat, a barge, a tank truck and rail transport.

50. A method for the reception, processing, handling and marketplace distribution of LNG and CNG from an energy hub, said method comprising.

(a) receiving and offloading LNG or CNG at receiving and offloading facilities;

(b) directing a first portion of the received and offloaded LNG or CNG from said receiving and offloading facilities to the marketplace by means of a distribution system;

(c) directing a second portion of the received and offloaded LNG or CNG from said receiving and offloading facilities to an underground storage facility wherefrom they may be subsequently directed to the marketplace by means of a distribution system; and (d) storing said second portion of the received and offloaded LNG or CNG in said underground storage facility.

51. The method of claim 50, wherein said LNG or CNG arrive at said receiving and offloading facilities by pipeline.

52. The method of claim 50, wherein said LNG or CNG arrive at said receiving and offloading facilities by a carrier selected from the group consisting of a marine vessel, a ship, a boat, a barge, a tank truck and rail transport.

* * * * *